US006036233A

United States Patent [19]

Braun et al.

[11] Patent Number: 6,036,233

[45] Date of Patent: Mar. 14, 2000

[54] DATA CARRIER WITH AN OPTICALLY VARIABLE ELEMENT

[75] Inventors: Eckhard Braun, Munich; Johann Muller, Poing; Reinhard Plaschka, Munchen; Franz Daniel, Ismaning, all of Germany

[73] Assignee: Giesecke & Devrient GmbH, Munich, Germany

[21] Appl. No.: 08/860,627

[22] PCT Filed: Nov. 2, 1996

[86] PCT No.: PCT/EP96/04762

§ 371 Date: Sep. 18, 1997

§ 102(e) Date: Sep. 18, 1997

[87] PCT Pub. No.: WO97/17211

PCT Pub. Date: May 15, 1997

[30] Foreign Application Priority Data

Nov. 3, 1995 [DE] Germany ..... 195 41 064

[51] Int. Cl.[7] ..... B42D 15/00

[52] U.S. Cl. ..... 283/91; 283/72

[58] Field of Search ..... 283/94, 91, 904, 283/107–111, 93; 428/916, 915, 204; 156/277, 283

[56] References Cited

U.S. PATENT DOCUMENTS

| | | | |
|---|---|---|---|
| 4,124,947 | 11/1978 | Kuhl et al. . | |
| 4,250,217 | 2/1981 | Greenaway . | |
| 4,506,916 | 3/1985 | Kuhl | 283/91 |
| 4,564,409 | 1/1986 | Kuhl | 283/94 X |
| 4,589,686 | 5/1986 | McGrew | 283/91 X |
| 4,715,623 | 12/1987 | Roule et al. | 283/91 |
| 4,932,685 | 6/1990 | Mancuso | 283/91 |
| 4,968,064 | 11/1990 | Mancuso | 283/91 |
| 5,298,922 | 3/1994 | Merkle et al. | 283/85 X |
| 5,413,659 | 5/1995 | Koskenmaki et al. | 156/229 |
| 5,437,897 | 8/1995 | Tanaka et al. | 428/915 X |
| 5,529,829 | 6/1996 | Koskenmaki et al. | 428/167 |
| 5,582,103 | 12/1996 | Tanaka et al. | 283/93 X |
| 5,722,693 | 3/1998 | Wicker | 283/91 X |
| 5,772,248 | 6/1998 | Phillips | 283/72 X |

FOREIGN PATENT DOCUMENTS

| | | |
|---|---|---|
| 1019012 | 10/1977 | Canada . |
| 0 085 066 | 8/1983 | European Pat. Off. . |
| 157921 | 10/1985 | European Pat. Off. . |
| 0 440 045 A2 | 1/1991 | European Pat. Off. . |

*Primary Examiner*—Willmon Fridie, Jr.
*Attorney, Agent, or Firm*—Bacon & Thomas, PLLC

[57] ABSTRACT

A data carrier with an optically variable structure is described having an embossed screen which is combined with a coating contrasting with the surface of the data carrier in such a way that different optically variable effects occur at different angles. Embossed screen and/or coating are executed in such a way that especially striking or additional effects occur which are suitable for determining the authenticity of the data carrier but cannot be reproduced, or reproduced true to the original, with the help of copying machines.

15 Claims, 11 Drawing Sheets

DATA CARRIER WITH AN OPTICALLY VARIABLE ELEMENT

BACKGROUND OF THE INVENTION

1. Field of the Invention

This invention relates to a data carrier with an optically variable structure verifying the authenticity of the data carrier and including an embossed screen which is combined with a coating contrasting with the surface of the data carrier in such a way that at least partial areas of the coating are completely visible upon perpendicular viewing but concealed upon oblique viewing, so that a tilting effect arises upon alternate perpendicular and oblique viewing, i.e. first information is recognizable at least at one predetermined angle but invisible or barely visible upon perpendicular viewing.

2. Related Art

For protection against imitation, in particular with color copiers or other reproduction methods, one equips data carriers, for example bank notes, papers of value, credit or identity cards or the like, with optically variable security elements, in particular holograms. This protection from forgery is based on the fact that the optically variable effect, which is readily and clearly recognizable visually, cannot be rendered, or not rendered properly, by the abovementioned reproduction devices. A data carrier with such a hologram is known e.g. from EP 440 045 A2. This print proposes applying the hologram as a prefabricated element or as an embossing in a layer of lacquer applied to the data carrier.

However, other optically variable elements can also be incorporated in data carriers alongside these holograms. For example CA 1019 012 discloses a bank note which is provided with a parallel printed line pattern in a partial area of its surface. To produce the optically variable effect a line structure is additionally embossed into the data carrier in the area of this line pattern so as to create flanks which are visible only at certain viewing angles. By selectively disposing the line pattern on like-oriented flanks one can make the lines visible upon oblique viewing of the flanks provided with these lines, while the line pattern is not recognizable upon oblique viewing of the backs of the flanks. If one provides phase jumps in the line screen or in the embossed screen in partial areas of the embossed surface one can represent information which is recognizable either only from the first oblique viewing angle or only from the second viewing angle.

SUMMARY OF THE INVENTION

The problem of the present invention is to improve the known security element with the incorporated embossing with regard to security aspects.

The invention is based on the idea of supplementing an optically variable security element having an embossed structure combined with a printed image, line screen or the like, also referred to as a coating below, in such a way as either to strengthen the known optically variable effect, or add at least one further visually recognizable effect to the known optically variable effect. Although the entirety of the optically variable effect produced by the combination of background and embossing and the additional effect is visually recognizable, it cannot be reproduced with the help of copying machines. It can thus serve as information for checking whether the document is an original, or the presence of the optically variable effect or effects can prove that the document was not produced by commercial reproduction techniques. This basic idea can be realized according to the invention in several variants which differ substantially in that the strengthening of the known effect, or the additional information, is produced in different ways.

The basic idea of the invention realized in the various embodiments is characterized by a number of advantages over the prior art. The forgery-proofness of the document is clearly increased by providing the strengthening or additional effect. It is also easier to recognize the security element in the data carrier, since the element is easy to find and more clearly recognizable due to the additional effects. The optically variable structure can exist as a separate element on the data carrier or as part of the data carrier, so that there are a great number of specific possibilities of realization.

BRIEF DESCRIPTION OF THE DRAWINGS

Further advantages and advantageous developments will result from the following description of embodiments with reference to the schematic figures, in which:

FIG. 29 shows an optically variable structure in exact register on each side of a data carrier embossed through.

DETAILED DESCRIPTION OF THE PREFERRED EMBODIMENTS OF THE INVENTION

Figure 1:
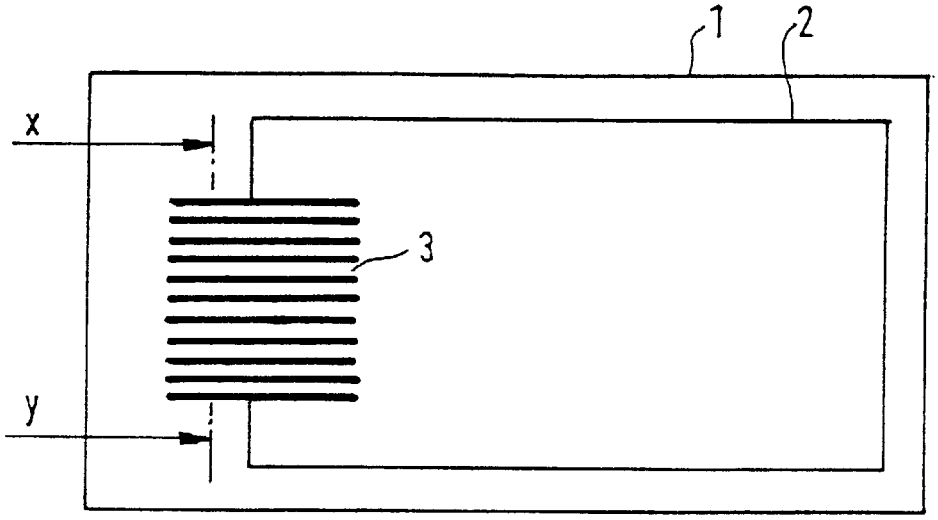
FIG. 1 shows a data carrier embodying the invention.

FIG. 1 shows data carrier 1 with optically variable structure 3 placed in printed image area 2 of the data carrier and in the printfree area. Optically variable structure 3 is used according to the invention as a so-called human feature, i.e. a feature testable by a person without aids, possibly alongside other features for ascertaining the authenticity of the data carrier. It is especially useful to provide such features in bank notes, but also in other money-equivalent documents such as stocks, checks and the like. Data carriers within the scope of the invention include cards like those used today e.g. for identifying persons or for carrying out transactions or services.

Optically variable structure 3 can be of very different design resulting in the different effects from different viewing directions. The optically variable structure generally consists of a coating contrasting with the surface of the data carrier in the form of a screen produced by printing or in another way or an all-over or closed layer which can likewise be produced by printing or in another way, for example by means of a transfer method. The effects to be employed for determining the authenticity of the data carrier are produced by the embossed screen cooperating with the coating in accordance with the structure of coating and embossed screen and their mutual coordination.

All structures according to the invention have in common that they and the resulting effects cannot be duplicated with the help of reproduction techniques known today.

In the following some examples of various preferred embodiments of the invention will be explained with reference to the figures. The representations in the figures are greatly schematized for clarity's sake and do not reflect actual constructions.

The embodiments described in the following examples are reduced to the essential core information for clarity's sake. In practical application the line structures of the coating/printed screens are not necessarily straight, but preferably curved or even intertwined, i.e. in the form of guil-loches. The same holds for the embossed screen structures. The information represented as simple bars in the following examples can likewise be replaced by picture or text information as elaborate as desired. The line screen structures usually exploit the possibilities of printing technology. Typical line widths are accordingly in the range of approx. 50 to 1000 microns. The embossed screen structures are generally selected in the range of 50 to 500 microns amplitude height.

The various embodiments are not restricted to being used in the described form, but can also be combined with one another to enhance the effects.

EXAMPLE 1 (FIGS. 2, 3, 4 and 5)

Figure 2:
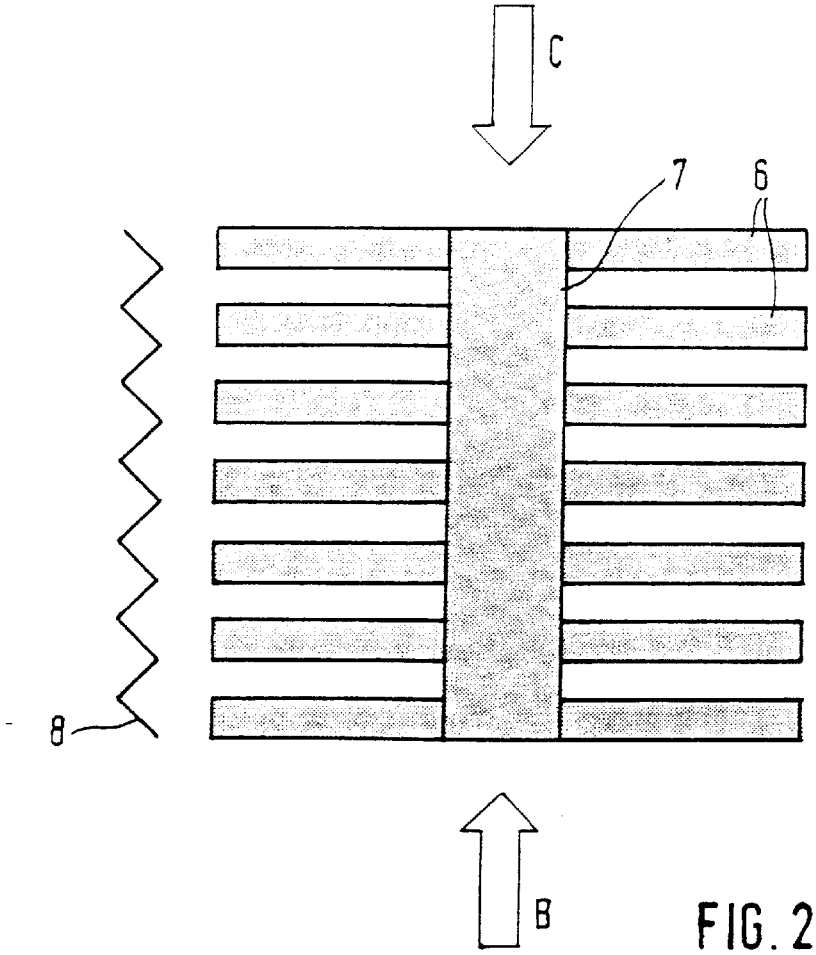
FIG. 2 shows an optically variable structure with information printed all over in a plan view.
Figure 3:
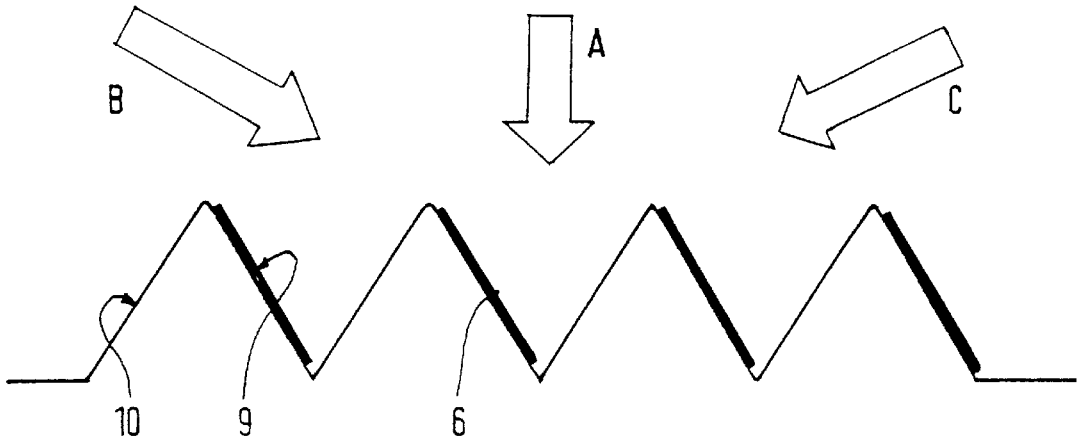
FIG. 3 shows the embossing of the optically variable structure of FIG. 2 in cross section.
Figure 4:
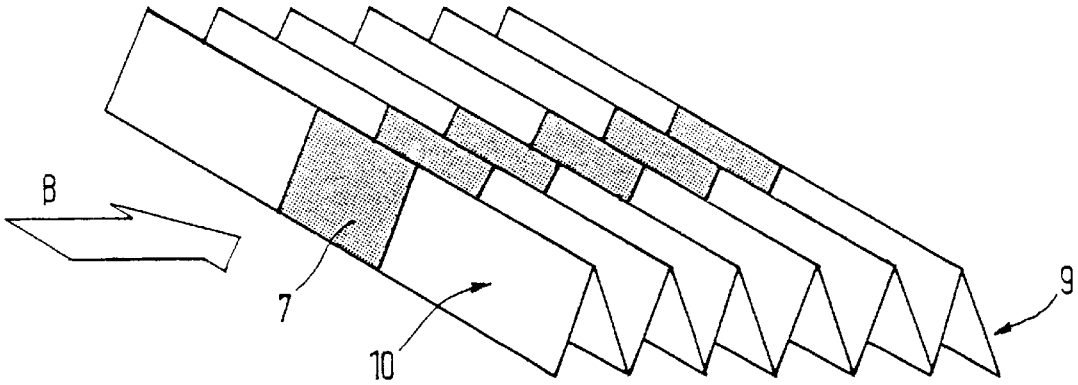
FIG. 4 shows the optically variable structure of FIG. 2 in a perspective view from a first viewing direction.
Figure 5:
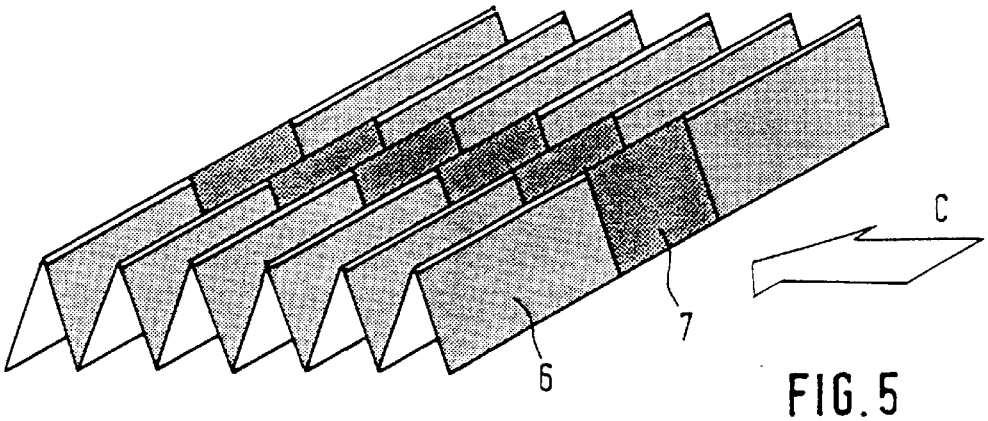
FIG. 5 shows the optically variable structure of FIG. 2 in a perspective view from a second viewing direction.
Figure 6:
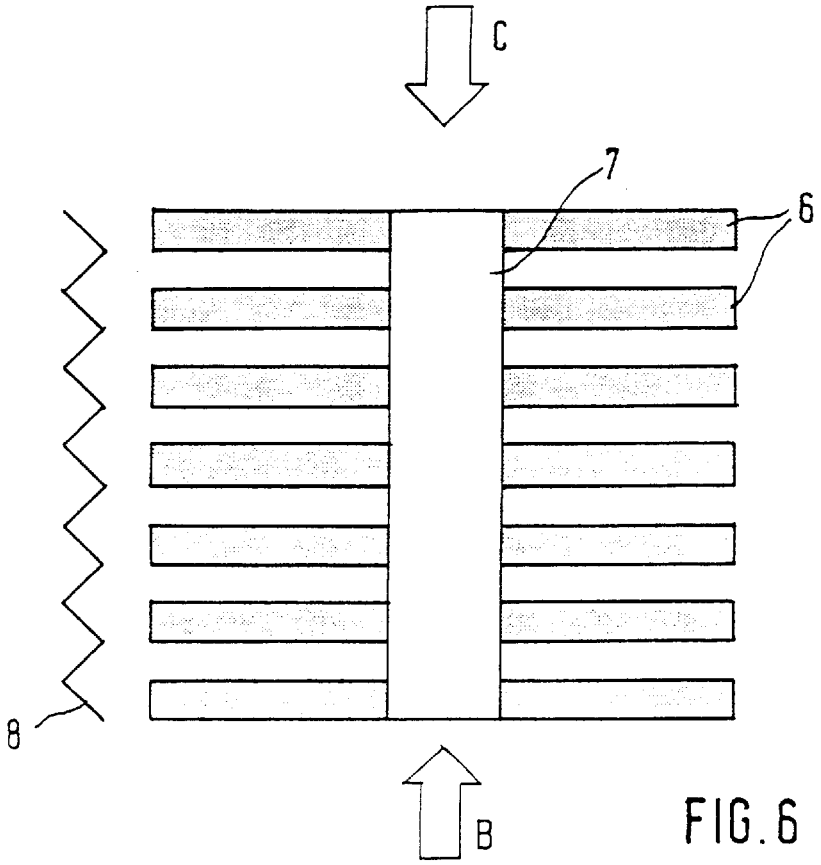
FIG. 6 shows an optically variable structure with information represented by a gap.
Figure 7:
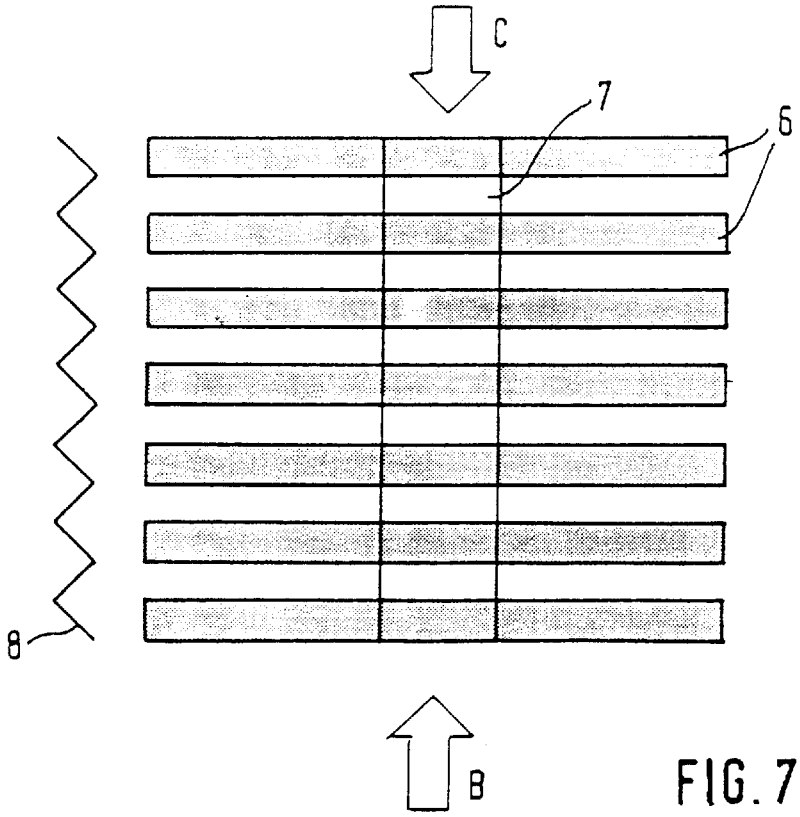
FIG. 7 shows an optically variable structure with information represented by nonembossing.
Figure 8:
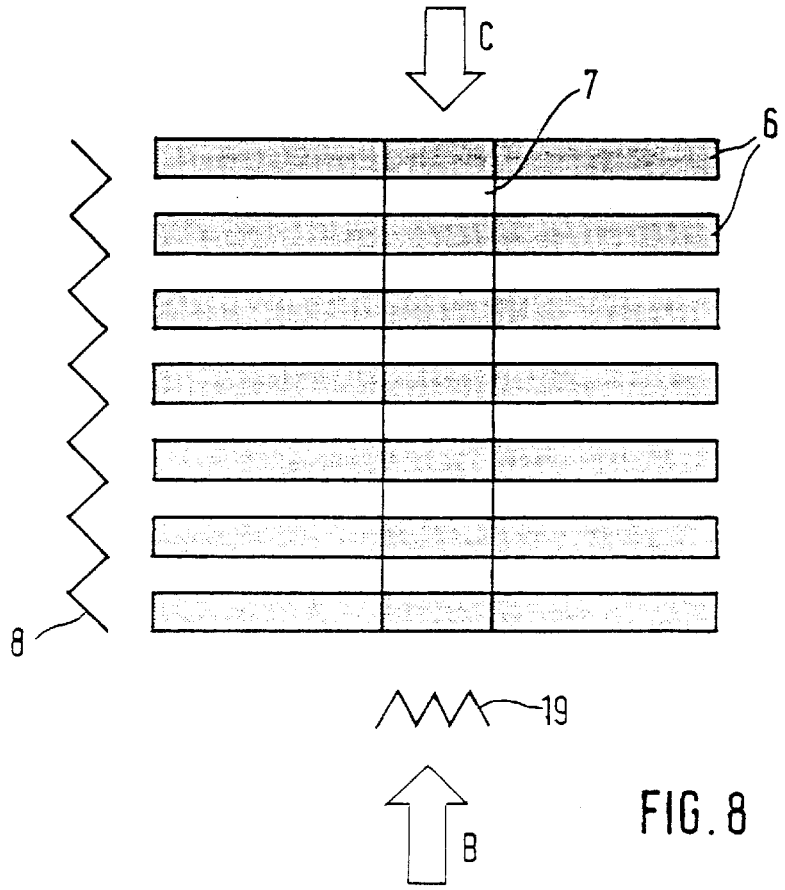
FIG. 8 shows an optically variable structure with an additional embossed structure.
Figure 9:
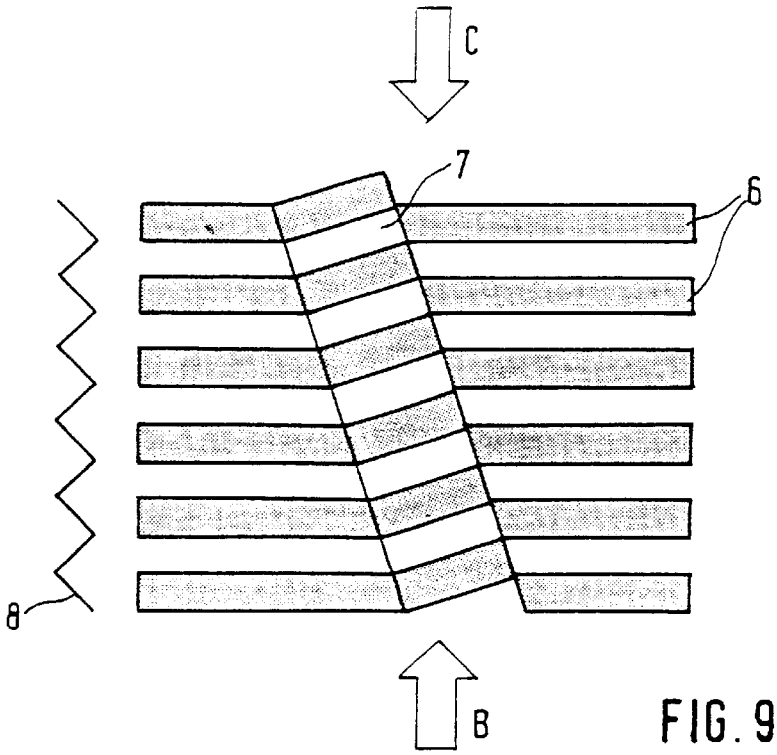
FIG. 9 shows an optically variable structure with information produced by a change of screen orientation.

FIG. 2 shows in conjunction with FIGS. 3, 4 and 5 an optically variable structure wherein the coating consists of parallel straight printed screen 6. The width of the printed lines corresponds approximately to the width of the gaps. Information 7, which in this case consists of an all-over print, is disposed perpendicular to the printed screen. Embossing 8, shown schematically in the left edge area of FIG. 2 in accordance with its structure and coordination with line screen 6, is positioned congruent to the printed screen in such a way that the embossed screen flank facing the viewer upon oblique viewing from viewing direction B coincides with the particular gap of the printed screen, and surface 9 facing away from the viewer from the same viewing direction coincides with the printed lines of printed screen 6. This relation is illustrated in FIGS. 3 to 5. The embossing flanks facing the viewer from viewing direction B are marked as position 10, the flanks facing away as position 9. Line screen 6 is rendered as a black coating in the schematic sectional view of FIG. 3.

FIGS. 3 to 5 show primarily the course and structure of the embossing as well as the arrangement of the coating on flanks 9, 10 of the embossing. Representation of data carrier 1 is largely neglected unless needed for clarity's sake.

In the shown example the embossed screen is triangular. Depending on the design of the embossing mold, however, the screen can also be trapezoidal, sinusoidal, semicircular or another shape.

The effects of the optically variable structure according to FIG. 2 will be described further in the following with reference to FIGS. 3, 4 and 5.

When the optically variable structure is viewed from viewing direction A, i.e. perpendicular to the surface of the data carrier, information 7 is completely recognizable in the surrounding field of printed screen 6. In the case of a black-and-white screen the surrounding field appears in a certain gray tone depending on the periodicity of the screen. A line-to-gap ratio of 1:1 results in a gray tone with a surface coverage of 50%. Upon oblique viewing of the optically variable element from viewing direction B, information 7 appears in an unprinted surrounding field since the embossed screen flanks facing the viewer are unprinted and only have information 7 printed all over (see FIG. 4).

When the data carrier is viewed from viewing direction C opposite viewing direction B, information 7 is not recognizable, provided line screen 6 and information 7 have the same layer thickness and are made of the same material, because embossed structure flanks 10 facing the viewer from this viewing direction are completely covered (see FIG. 5). The viewer accordingly sees e.g. a completely printed surface in which the information is not recognizable because of lack of contrast with the surroundings. For clarity's sake, however, information 7 is shown in slight contrast with the line screen in FIG. 5.

Upon a change from viewing direction B to viewing direction C the optically variable structure described thus shows a tilting effect with a completely different information content. The latter is easy to recognize but cannot be reproduced for example by a copying machine because the copying machine scans originals exclusively from viewing direction A, i.e. perpendicular to the document surface, and can reproduce only the information content recognizable from viewing direction A.

EXAMPLE 2 (FIG. 6)

Printed screen 6 is a parallel, straight screen as in Example 1. In this example, however, information 7 is represented by a printfree, left-out space. Embossing 8 is congruent to printed screen 6 and positioned relative to the printed screen in the way described for Example 1. In this example the information is not embossed, i.e. the embossed screen is interrupted in the area of the information.

When this optically variable structure is viewed perpendicular, information 7 in the screened surrounding field is easy to recognize. When the structure is viewed from viewing direction B the information disappears because the unprinted flanks of the embossed structure face the viewer from this direction. From opposite viewing direction C the information appears as a printfree area in a completely printed surrounding field.

The same or very similar effects result if congruent embossed structure 8 also extends over the unprinted area of information 7 or if the area of information 7 is embossed so as to be altogether raised, but in an unembossed form information 7 makes a more homogeneous impression (from viewing direction C). Information 7 is also slightly recognizable at the glancing angle of the data carrier from any viewing direction because of the different surface structure of the embossed and unembossed areas.

EXAMPLE 3 (FIG. 7)

A continuous line screen is selected as printed screen 6 in this example without providing information produced by printing. Embossing 8 is congruent to the printed screen and positioned relative to the printed screen, as in the preceding examples, in such a way that the line screen is disposed on flanks 9. The embossing is interrupted in the area of information 7 to be represented.

When this optically variable structure is viewed perpendicular to the surface, only the printed screen without information is recognizable. At an oblique viewing angle from viewing direction B the information appears in an unprinted surrounding field in the form of an area with printed and unprinted surfaces. In the case of the selected representation with a surface coverage of printed and unprinted proportions in the area of information 7 of about 50%, the information thus appears in a gray tone against a white background. From opposite viewing direction C the information likewise appears in a gray tone, but in this case against a dark background (100% surface coverage) since the flanks of embossed screen 8 facing the viewer are completely printed.

EXAMPLE 4 (FIG. 8)

Line screen 6 and embossed screen 8 in this example correspond to the arrangement shown in Example 3. The difference is that further embossed screen 19 is provided, perpendicular to embossed screen 8, in the area of information 7 to be represented.

The effects to be observed from different viewing directions (A, B, C) correspond to those in Example 3, only that in the present embodiment the optically variable element is not recognizable at the glancing angle of the data carrier or upon superficial viewing from directions other than B, C intended for detection of the data.

EXAMPLE 5 (FIG. 9)

Line screen 6 in this example corresponds to the preceding printed screens. However, in the area of the information the line screen deviates from the predetermined course, e.g. by being disposed at right angles to the information contour. Embossing 8 extends parallel to the basic screen. In information area 7 there is no embossing.

When this optically variable structure is viewed perpendicular to the surface, the information is almost unrecognizable at the same screen frequency in the information and surrounding field areas because of the same surface coverage. When the structure is viewed from viewing angle B, information 7 appears in a gray tone against a light surrounding field, while from viewing direction C the information appears in a gray tone against a dark background.

Alongside the different orientation of the printed screen in the area of information 7, the screen frequency in the information area can also deviate from that in the surrounding field area. The more the screens differ from each other, however, the more visible the information is upon viewing perpendicular to the surface.

EXAMPLE 6 (FIG. 10)

In this example the printed screen consists of two-colored line print 11, 12, the lines being adjacent. First information 13 is represented by gaps in lines 11 of the first color, while second information 14 is represented by corresponding gaps in lines 12 of the second color. Embossed structure 8 is disposed parallel to the basic structure and extends over the entire printed screen. The embossed screen is positioned in such a way that lines 11 of the first color are each disposed on a first flank of the screen and lines 12 of the second color on the opposite flank of the screen.

When this optically variable structure is viewed by reflected light, a mixed color from the colors of lines 11 and 12 can be seen. Pieces of information 13 and 14 cannot be separated from each other if they overlap. When the structure is viewed from viewing direction B, however, only information 13 appears as a white surface in a colored surrounding field according to the color of lines 11, while information 14 is unrecognizable. From opposite viewing direction C information 14 appears white against a colored surrounding field according to the color of lines 12, while information 13 is invisible.

EXAMPLE 7 (FIG. 11)

In this example, line screen 6 is interrupted according to the information contour. Within the information contour, however, the line screen runs on with a phase shift in the screen gaps. The shifted line areas are marked as position 16, the gaps in the information area as position 17. Outside the printed screen the information is supplemented by all-over print 18. Embossing 8 extends parallel to the basic screen over the entire surface, additional information 18 remaining unembossed.

When the optically variable structure is viewed perpendicular to the surface, the information is only recognizable in fragments. Upon viewing from direction B the phase shift causes only the part of the information in the embossed screen to appear dark against a light background, thereby supplementing additional information 18 printed outside the embossed structure. From this viewing direction the total information is thus clearly recognizable against a light background. From opposite viewing direction C the information in the embossed screen area appears light against a dark background, likewise supplementing additional information 18 located outside the embossed screen.

EXAMPLE 8 (FIG. 12)

The optically variable structure consists of line screen 6 which is interrupted. In the interruption, information 7 is represented by a second line screen disposed perpendicular to basic screen 6. First embossing 8 extends congruent to line screen 6, while second embossing 19 accordingly extends congruent to information screen 7. Both screens are positioned relative to the printed screens as in the preceding examples.

When this optically variable structure is viewed perpendicular to the surface, a largely homogeneous gray surface appears to the viewer without the information being recognizable. When the structure is viewed from viewing angle B the information appears in a gray tone against a light background. From opposite viewing direction C the information appears in the same gray tone but against a dark background.

From viewing direction D (perpendicular to viewing directions B, C) a white surface appears in the area of the information against a gray surrounding field which results from open screen structure 6. The information accordingly appears dark again against a gray background from viewing direction E (perpendicular to viewing directions B, C).

EXAMPLE 9 (FIG. 13)

In this example the coating consists of a parallel, straight line screen with comparatively thin screen lines 20 in relation to the gaps. The information is represented by widened areas 21 of lines 20. The widened areas of the lines can render a halftone image, as described e.g. in EP-PS 0 085 066. Embossing 8 extends parallel to the line screen and is positioned in such a way that the thin screen lines coincide with the embossed screen flanks facing away from viewing direction B. Depending on their size, widened areas 21 of the information thus extend along the flanks or over the zeniths of the embossed structure onto the opposite flank.

When this structure is viewed perpendicular to the surface, the halftone image represented by the widened areas of the lines appears in light gray surroundings. From viewing direction B thin screen lines 20 are located on the embossed screen flanks facing away from the viewer. The lighter halftones of the information, which are represented by only slightly widened areas of screen lines 21, are thus already no longer visible. The picture information is thus thinned out, the surroundings of the picture information appear white. Upon oblique viewing at a relatively flat angle one recognizes only a residual amount of the information consisting of the dark halftones.

From viewing direction C screen lines 20 face the viewer; when the structure is turned from perpendicular viewing to a flat angle the dark halftones are first masked from this viewing direction. However the screen lines remain visible. Only at a very flat angle does the entire structure appear dark in a full tone.

EXAMPLE 10 (FIG. 14)

In this example the optically variable structure consists of individual printed screen elements 25, 26, 27 and 28. The printed screens in the individual elements are differently oriented, extending vertically in element 25, extending horizontally in element 26, extending diagonally in element 27 and likewise extending diagonally in element 28 but with a different orientation compared to element 27. The individual embossed screens are coordinated accordingly with the single elements.

To produce an optically variable structure the single elements are assembled into a total structure.

When this optically variable structure is viewed perpendicular to the surface, the viewer sees a total picture composed of the partial pictures of single elements 25 to 28. From the different oblique viewing angles one recognizes different total patterns which, depending on the composition of the single elements, yield a characteristic pattern which is not visible upon perpendicular viewing.

Figure 14:
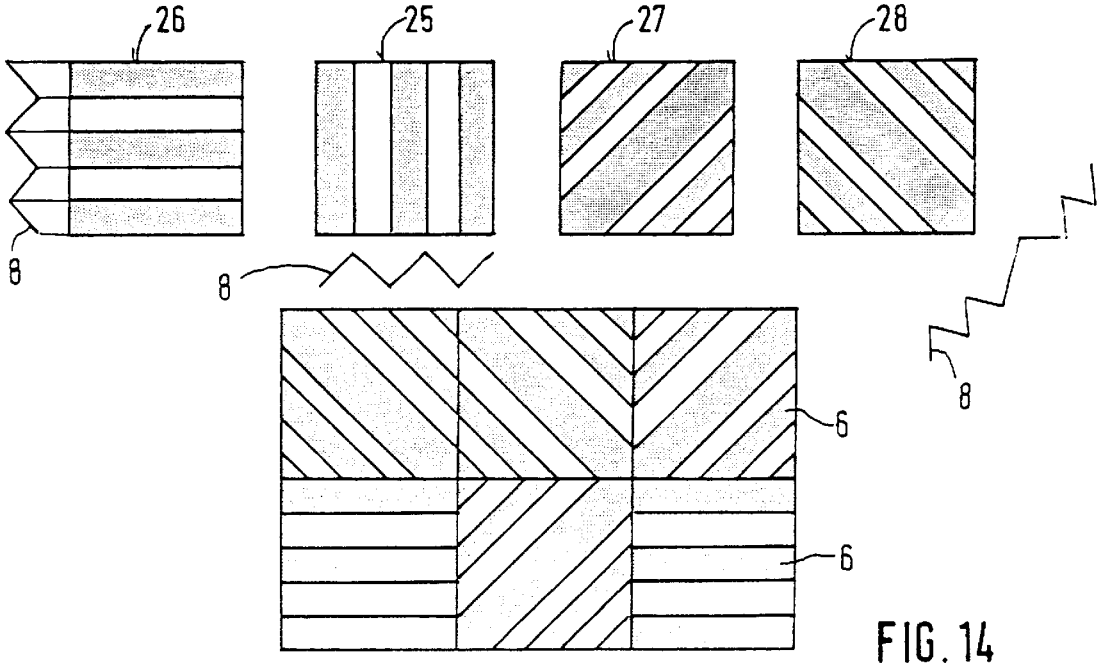
FIG. 14 shows an optically variable structure composed of single structures.

Single elements 25, 26, 27 and 28 shown in FIG. 14 render only very simple embodiments. It is clear to the expert that both the form of these elements and the line and embossed structures provided therein can be varied as desired so that the combination of such elements results in an almost endless number of design possibilities.

EXAMPLE 11 (FIG. 15)

The optically variable structures described in this example differ from the hitherto described structures substantially in that the linear coating screen is disposed on the zeniths of the congruently executed embossed screen, the lines of the coating screen extending over various distances symmetrically on both sides of the flanks starting from the zeniths of the sinusoidal screen.

However, in this example line screen 6 of the optically variable structure is likewise parallel and straight, the line width corresponding approximately to the gap between the lines. After the data carrier is printed with the described printed screen the data carrier is embossed in the area of the optically variable structure in such a way that the embossing is congruent to the printed screen and extends into both flank areas 9, 10 starting from zeniths 32. The screen gaps are fitted into valleys 31 of the embossed structure in such a way that they also extend into the adjacent lower flank areas. The line screen is produced by flatbed printing or using other coating methods (transfer printing) with layer thicknesses which cause no essential thickening of the data carrier in the unembossed data carrier and accordingly still permit an even surface. The coating screen or line screen can thus be combined with any embossed structures and any embossed shapes. The embossed height of the sinusoidal screen is thus essentially greater than the thickness of the printed layer or a metallic coating applied for example by the transfer method. At an embossed height between 50 and 100 microns the thickness of the color layer or other coatings with an optically variable effect (metal layer, iriodine ink layer, liquid-crystal ink layer) is generally smaller than 10 microns.

Figure 15:
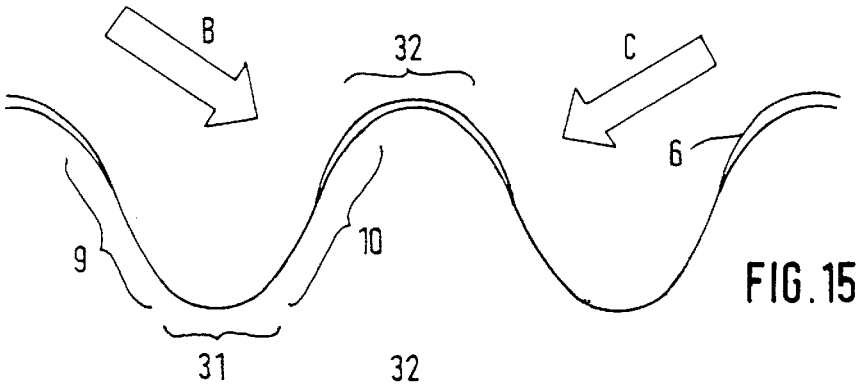
FIG. 15 shows an optically variable structure with printed screen lines on the embossing zeniths.
Figure 16:
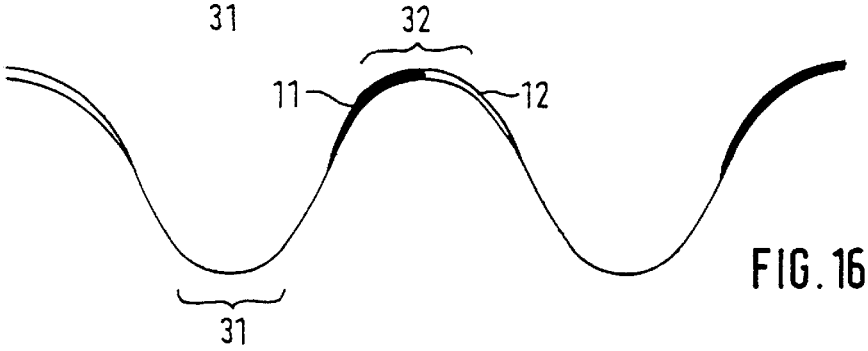
FIG. 16 shows an optically variable structure with a two-colored printed screen.
Figure 17:
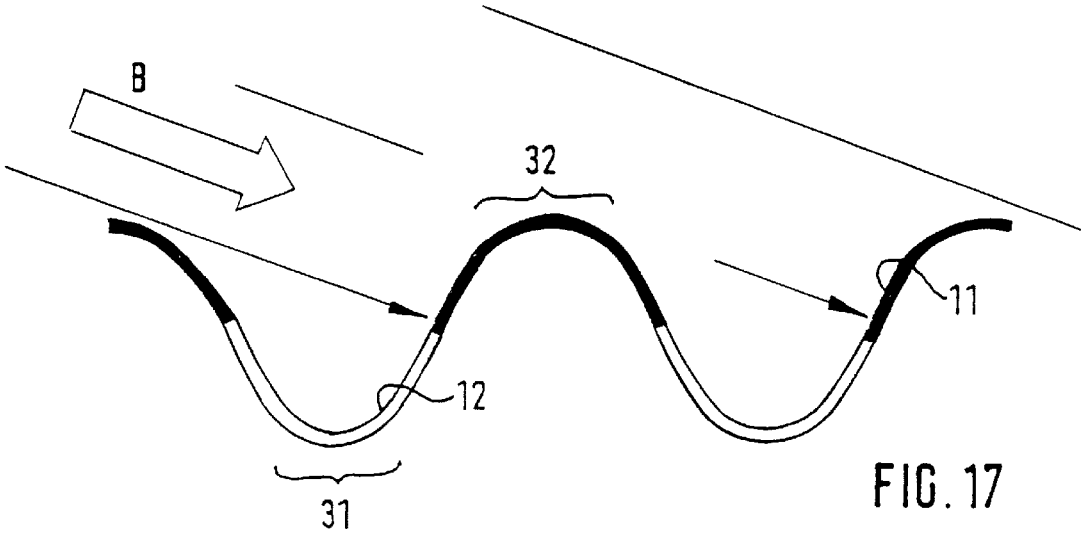
FIG. 17 shows an optically variable structure with a two-colored printed screen on the zeniths/valleys of an embossed screen.
Figure 18:
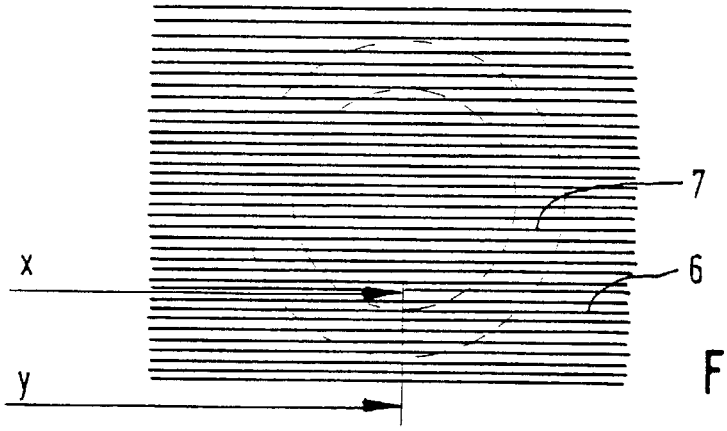
FIG. 18 shows an optically variable structure with an embossed screen of different embossed height.
Figure 19:
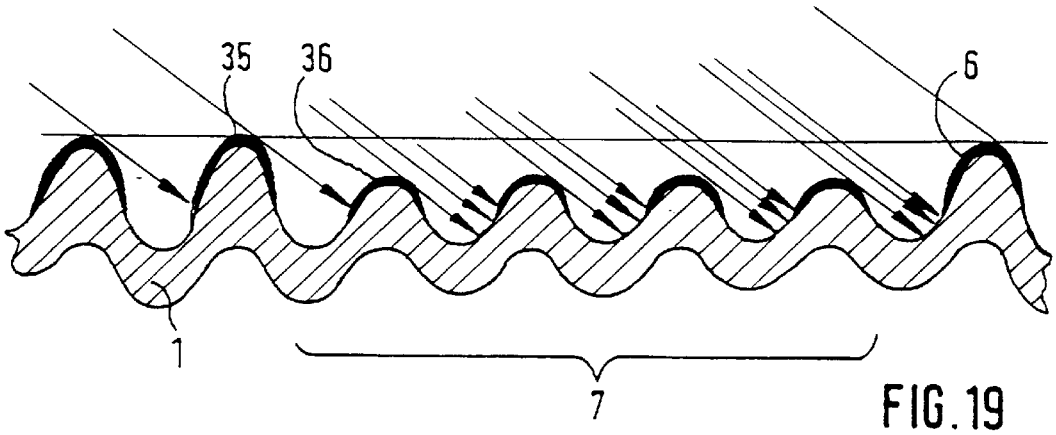
FIG. 19 shows the optically variable structure of FIG. 18 in cross section.
Figure 20:
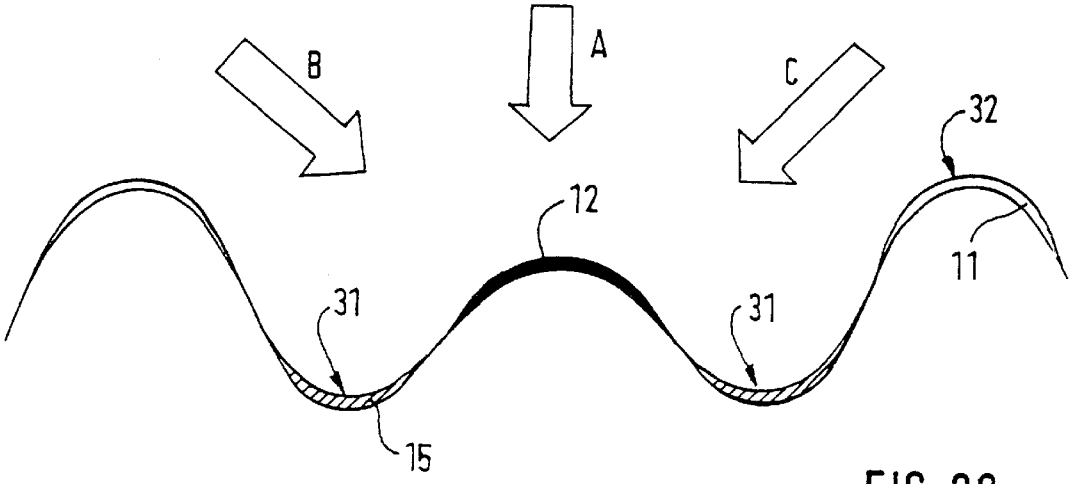
FIG. 20 shows an optically variable structure with a three-colored printed screen.
Figure 21:
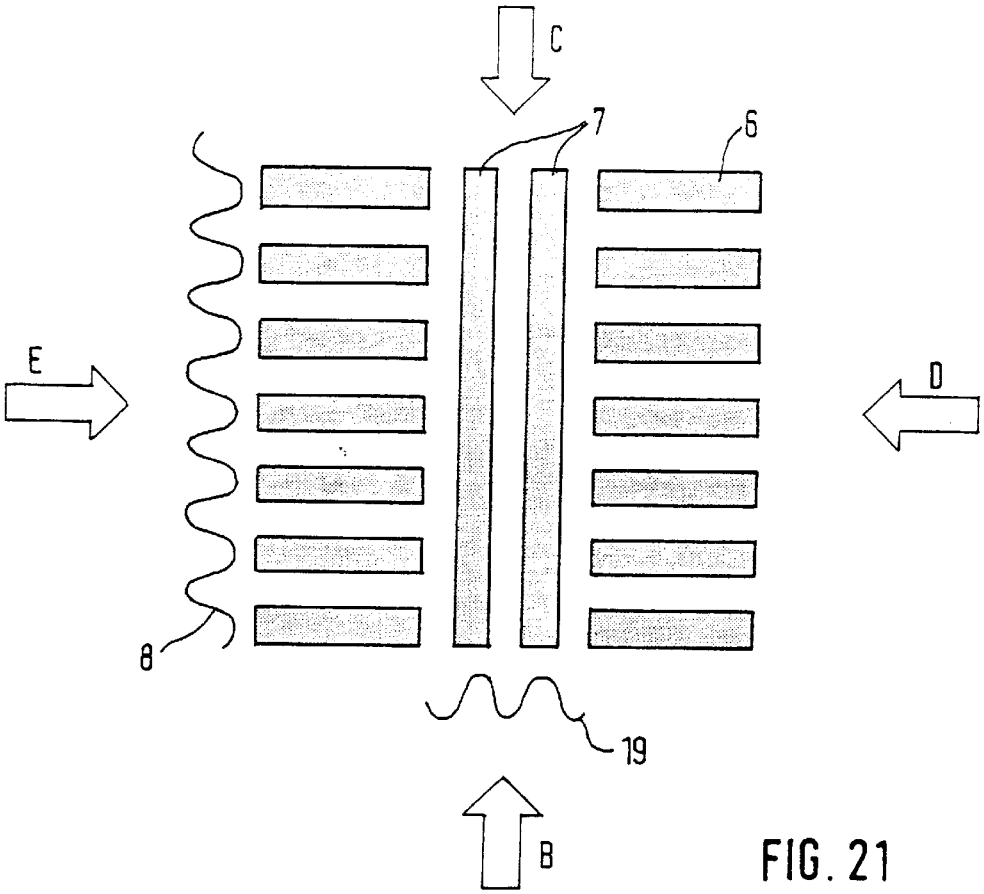
FIG. 21 shows the optically variable structure of FIG. 12 with sinusoidal embossing.
Figure 22:
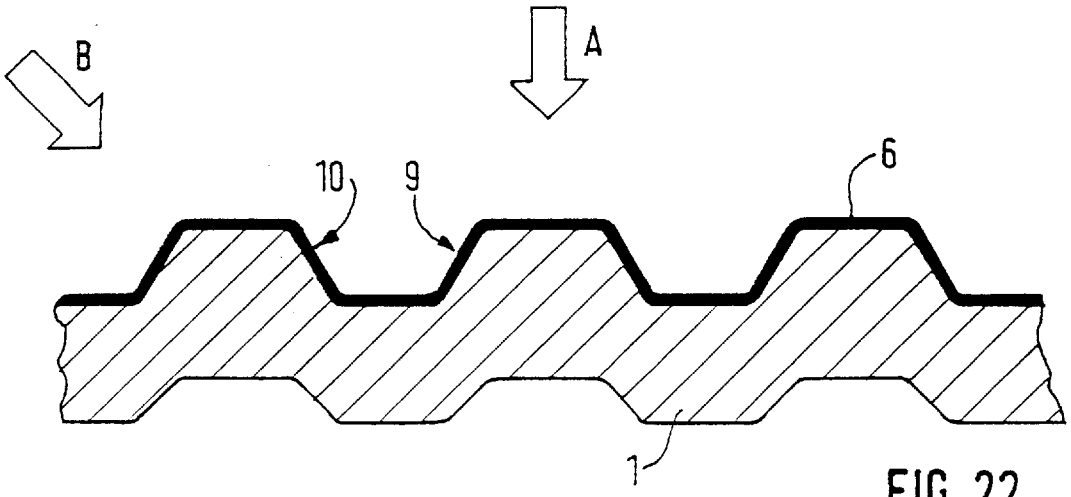
FIG. 22 shows a data carrier in cross section with an optically varying coating.
Figure 23:
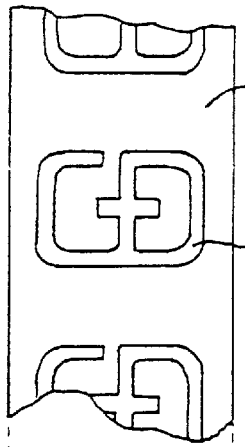
FIG. 23 shows an optically variable structure with information in the form of gaps in an iriodine coating.

When the embossed structure of the optically variable element shown schematically in FIG. 15 is viewed perpendicular to the surface, line screen 6 is recognizable in a gray tone or a reduced color saturation of a certain color, depending on the execution (ratio of line width to gap). From viewing directions C and B unprinted valleys 31 of the embossed screen are at first recognizable, depending on the inclination angle, until the structure passes into the all-over tone of the screen color at a flat viewing angle.

In this embodiment the optically variable element has the same tilting effect from viewing directions C and B.

EXAMPLE 12 (FIG. 16)

In contrast to the preceding example, the printed screen consists in this case of a two-colored line screen with colors 11 and 12 adjoining each other. Between the pairs of lines there are gaps which correspond approximately to the width of the pairs of lines. The embossing is congruent with the printed screen and positioned relative to the screen in such a way that the contact lines of the two-colored pairs of lines are disposed on zeniths 32 of the screen. Valleys 31 of the screen are unprinted.

When this optically variable structure is viewed perpendicular to the surface, the viewer sees a mixed color resulting from colors 11 and 12. From viewing direction B the viewer first sees the line screen with color 11 interrupted by the unprinted areas in valleys 31 at a steeper viewing angle until color 11 appears in the full tone at a flat angle. From viewing direction C the viewer accordingly first sees the line screen in color 12 and this color in the full tone at an accordingly flat viewing angle.

Figure 10:
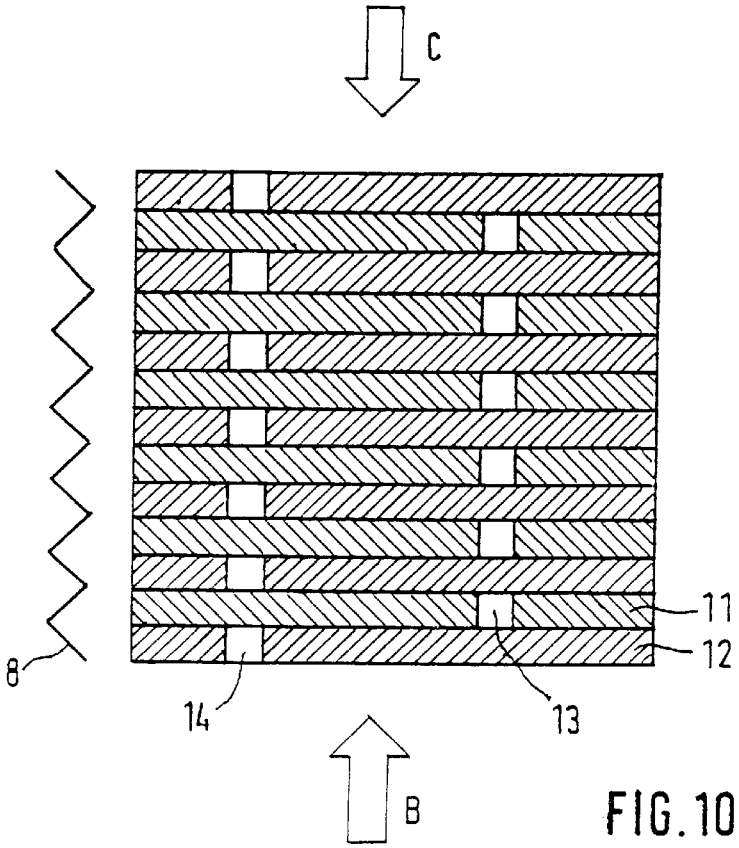
FIG. 10 shows an optically variable structure with two pieces of information produced by gaps.
Figure 11:
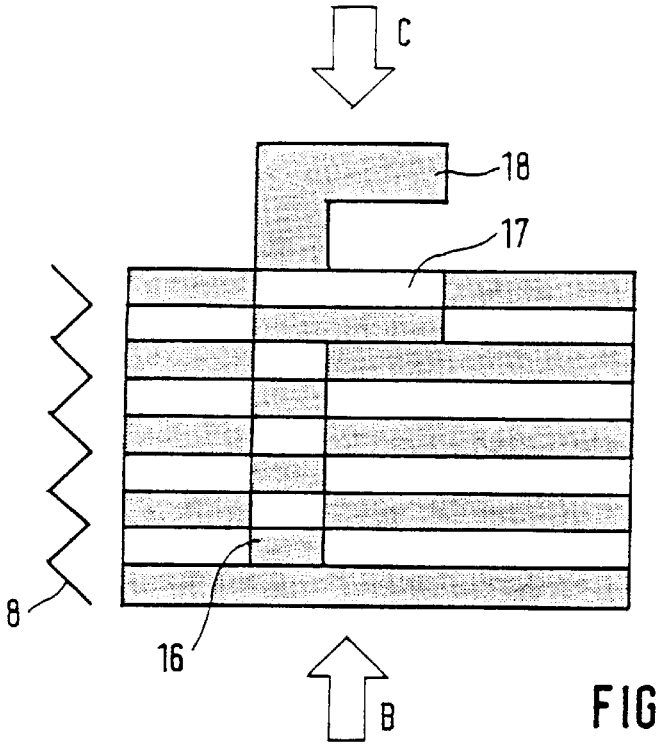
FIG. 11 shows an optically variable structure with supplementary addition information in the unembossed area.

Information can be incorporated in such a tilting structure according to the preceding examples in a great variety of ways, e.g. by providing gaps (FIG. 10) or by a corresponding phase shift in the printed line structure (FIG. 11).

EXAMPLE 13 (FIG. 17)

The line screen in this example is two-colored with colors 11 and 12 which adjoin without a gap. The embossing is again congruent to the printed screen, in such a way that color 11 coincides with zeniths 32 and color 12 accordingly with valleys 31. When this optically variable structure is viewed perpendicular to the surface, the viewer sees the mixed color resulting from single colors 11 and 12 at 100% surface coverage. Upon oblique viewing of the structure the optical impression changes, depending on the inclination angle, from the mixed color recognizable upon perpendicular viewing up to the full-tone color facing the viewer.

Information is incorporated as explained in Example 12.

EXAMPLE 14 (FIG. 18, FIG. 19)

In this example line screen 6 extends parallel and straight with corresponding gaps between the screen lines. The embossing is congruent with the printed screen, the printed lines coinciding with the zeniths of the embossed screen as in the preceding examples. Information 7 of the optically variable structure is represented in this example by an embossing which has lower amplitude 36 in the area of the information than embossed amplitude 35 in the area surrounding the information.

When the optically variable structure is viewed perpendicular to the surface, only the printed screen in a gray or color tone is recognizable without the information being visible. At an oblique viewing direction background area 6 first passes into a full tone at an increasingly flat angle, while information area 7 still appears in a gray tone since parts of the unprinted flanks are still recognizable in this area. At a very flat viewing angle the information area also appears in the full tone, i.e. the information disappears again.

A modification of this optically variable structure is for no embossing whatsoever to exist in the information area. In this case the information area still appears in a gray tone against the dark surroundings upon viewing at a very flat angle.

EXAMPLE 15 (FIG. 20)

The printed screen in this example is three-colored, consisting of colors 11, 12 and 15 which are printed spaced apart. The embossing is congruent to the printed screen with different amplitudes, higher amplitude 35 being about twice as high as the low amplitude in the present example. Color 11 is provided on zeniths 32 of the higher amplitude, and color 12 on the zeniths of the lower amplitude, while color 15 coincides with valleys 31 between the amplitudes of the embossed screen.

When the optically variable structure is viewed perpendicular to the surface, the viewer sees a mixed color resulting from colors 11, 12 and 15. Upon oblique viewing color 15 present in the valleys is first covered, depending on the inclination of the viewing angle, until color 12 on the lower amplitudes of the embossed structure disappears at an increasingly flat viewing angle and color 11 on the higher amplitudes of the embossed structures finally appears in the full tone.

In this embodiment the color effect thus changes from the mixed color resulting from three colors to the mixed color from two colors up to the single-colored full tone. This effect is the same from both viewing angles B, C.

EXAMPLE 16 (FIG. 21)

Figure 12:
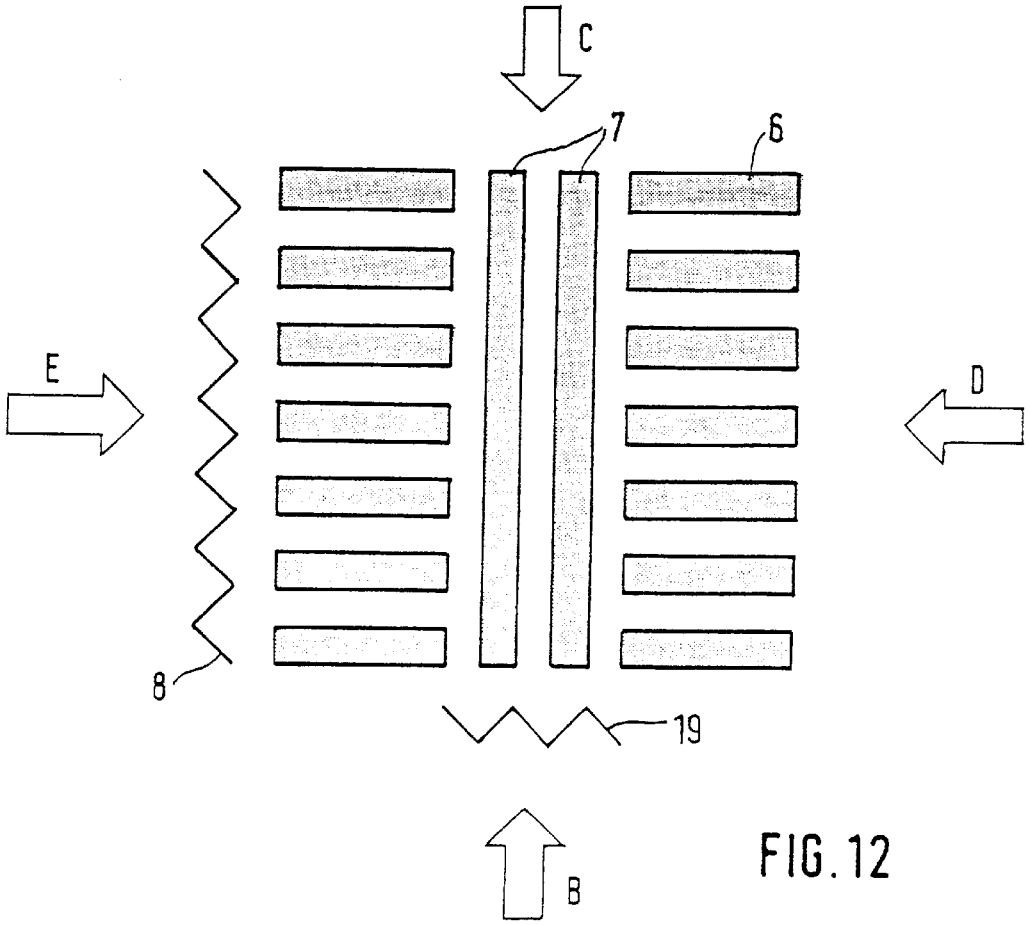
FIG. 12 shows an optically variable structure with two line and embossed structures with different angles.
Figure 13:
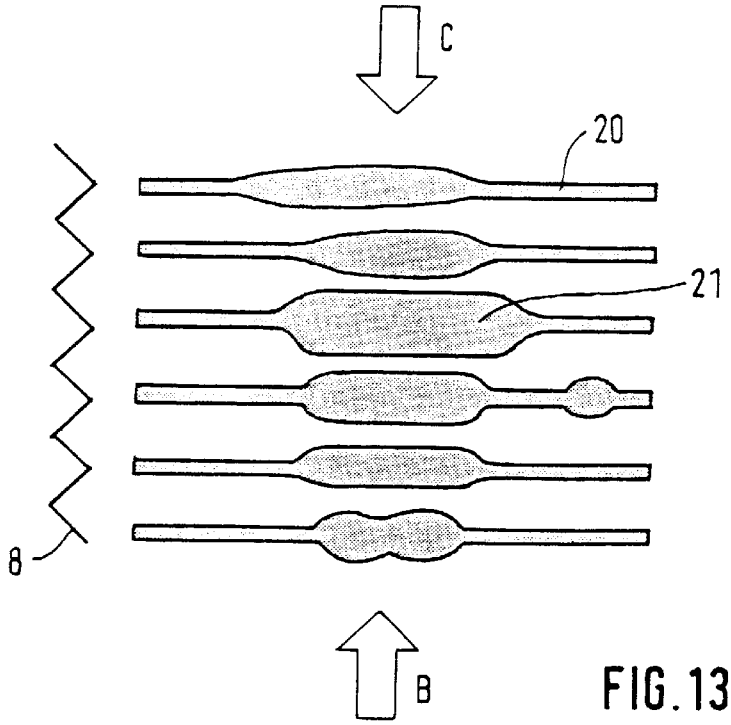
FIG. 13 shows an optically variable structure with information produced by widened areas of a line screen.

The optically variable structure shown in this example is very similar to the structure shown in FIG. 12 (Example 8). It differs only in that embossed screens 8 and 19 are sinusoidal and the screen lines are disposed on the zeniths of the embossed screens.

Upon perpendicular viewing the effect described in Example 8 arises. From viewing directions B and C information area 7 appears in a gray tone in dark surroundings. From viewing angles E or D, however, information area 7 appears in a dark full tone in a gray tone of the surrounding area.

EXAMPLE 17 (FIG. 22)

In this and the following examples at least parts of the coating contrasting with the surroundings are produced from colors or layers having optically variable properties. Optically variable colors or layers already show different optical effects themselves at different viewing angles. Such optically variable colors/layers are well known to the expert. Such colors generally have interference, diffractive, polarization or dichroic effects. They thus change their color effect at varying viewing angles depending on their nature and composition.

In the present example the surface of data carrier 1 is provided with coating 6 consisting of an optically varying color. At least in a partial area of coating 6 there is a line embossing, which is trapezoidal in this case. When the optically variable structure is viewed perpendicular to the surface of the coating (direction A), the embossed area appears in a different color from the unembossed area, since flanks 9 and 10 are inclined relative to the viewing direction and thus appear in a different color from the surroundings or the flattened plateaus and valleys of the embossed structure. When the optically variable structure is viewed from oblique viewing direction B, corresponding color changes are also recognizable which always bring out the embossed area in contrast with the unembossed area.

A further variation results-if the embossing has different flank angles or partial areas with different embossed profiles or different flank angles.

EXAMPLE 18 (FIG. 23, FIG. 24)

Figure 24:
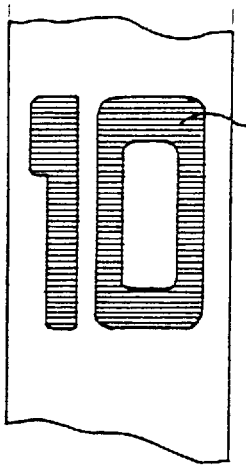
FIG. 24 shows the iriodine coating of FIG. 23 with an embossed structure.
Figure 25:
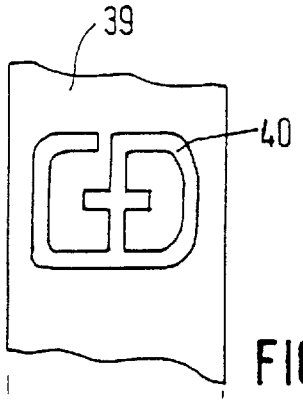
FIGS. 25, 26 show the optically variable structure of FIG. 23 with an underlaid printed screen.

In this example the data carrier is printed along stripe 39 with a so-called bodiless iriodine ink. These inks have the property that they are almost invisible upon perpendicular viewing since they are completely transparent, while generally having a striking color effect (for example a gold color) at a glancing angle. In the all-over iriodine coating information 40 is represented in the form of gaps. Furthermore an embossed screen is provided on the stripe within the contour lines of desired information 41. Embossed information 41 is overlaid on information 40 represented in the iriodine coating and shown separately in FIG. 24 only for clarity's sake.

When the optically variable structure is viewed perpendicular to the surface, information 40 and also 41 are almost unrecognizable. Upon oblique viewing of the structure, information 40 appears at a first glancing angle (total reflection), while embossed information 41 appears at another glancing angle since the embossed structure flanks have a different angle to the particular viewing direction than in the unembossed area. Information 40 and 41 are thus always recognizable only at different angles while being almost invisible upon perpendicular viewing.

EXAMPLE 19 (FIG. 25, FIG. 26)

Figure 26:
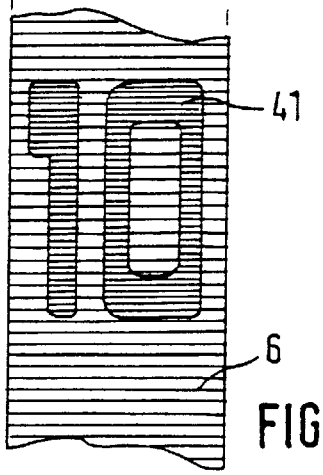
Figure 27:
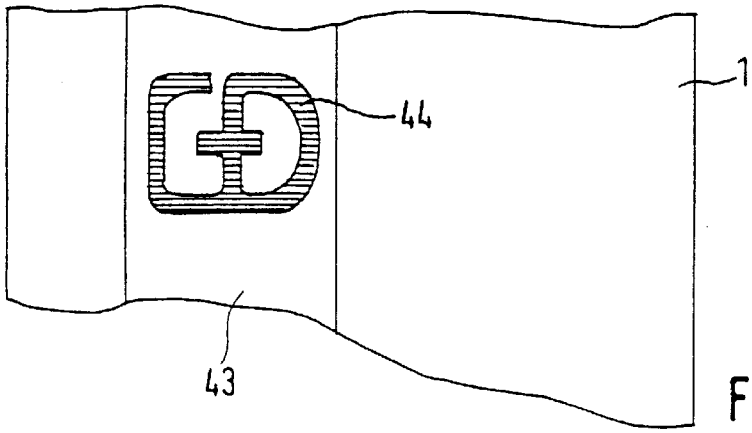
FIG. 27 shows an optically variable structure in the form of a metallic stripe with embossed information.
Figure 28:
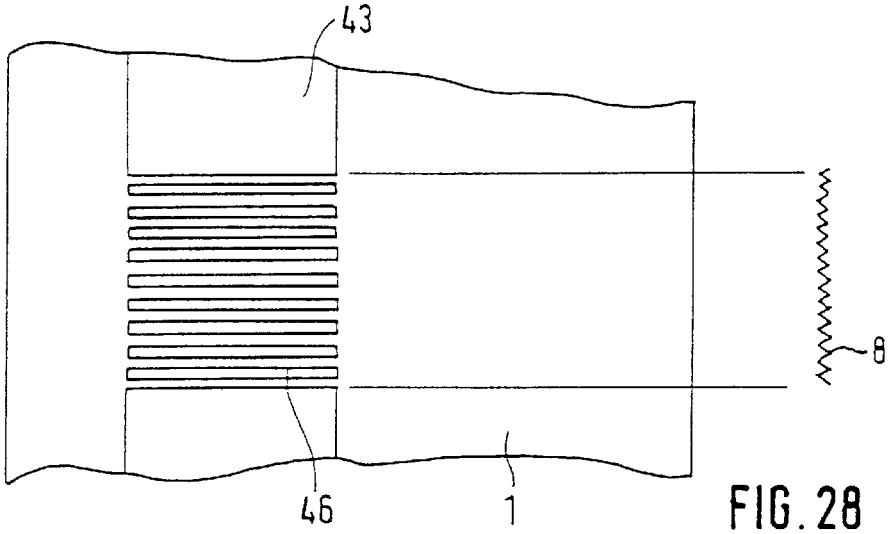
FIG. 28 shows an optically variable structure with information in the form of demetalized areas.
Figure 29:
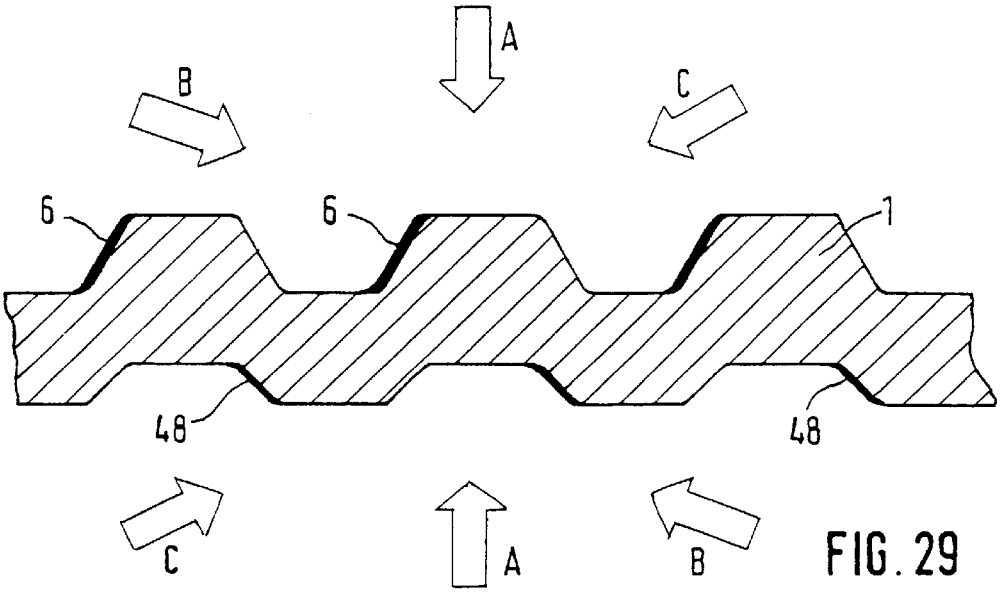

The optically variable structure in this example corresponds largely to the preceding example. Additionally embossed structure 41 is underlaid by colored line screen 6 in this example, as evident from FIG. 26. To represent information 41, the line screen can be shifted in the area of the contour lines of the information. It is also possible, however, to shift the embossed screen in the area of the information relative to the screen surrounding the information.

When this structure is viewed by reflected light, the printed screen is visible while information 40 left out of the iriodine coating is almost invisible. As in the preceding example, only information 40 appears at first at the glancing angle of the iriodine ink, while only embossed information 41 becomes visible at another glancing angle. Additionally this information also appears dark against light surroundings upon oblique viewing or light against dark surroundings from the opposite viewing direction, however, as described with reference to the preceding examples. Since the effect resulting from the combination of line and embossed screens is comparatively dominant in this example, the effect caused by the iriodine ink in the area of the embossing is unimportant in contrast to the preceding example.

EXAMPLE 20 (FIG. 27)

The optically variable structure consists in this example of high-gloss metallic coating 43 applied to data carrier 1, for example by the transfer method. Embossed screen 44 is provided within the metallic coating, within the contour of the characters to be represented.

When this optically variable structure is viewed perpendicular to the surface, the embossed screen appears semidull in glossy, dark surroundings. When viewed from different viewing directions a reversal of the light/dark effect results in the glancing angle area of the metallic coating.

Metallic stripe 43 can also have a holographic structure, so that the described effect is overlaid by the holographic information outside embossed information 44. In the embossed area the holographic information is destroyed.

EXAMPLE 21 (FIG. 28)

In this example metal stripe 43 has line screen 40 in the form of demetalized areas. In the area of the demetalized areas the metal stripe is provided with embossed screen 8 which is executed congruent to the metallic line screen.

When this optically variable structure is viewed perpendicular to the surface, line screen 46 is recognizable. Upon oblique viewing a metallically dull surface in glossy surroundings appears, while from the opposite viewing direction a completely demetalized surface in a metallically glossy surrounding field appears.

EXAMPLE 22 (FIG. 29)

The optically variable structure in this example is characterized in that first printed screen 6 is provided on the front of data carrier 1, and second printed screen 48 on the back of the data carrier. At least parts of the two printed screens are printed in exact register, which is generally done with so-called simultaneous printing processes. The embossing is executed in this example in such a way that it exists as a positive/negative embossed screen on both sides.

Depending on the execution of the printed and embossed screens, the effects described with reference to the preceding examples result from particular viewing directions A, B, C both on the front and on the back. In addition, transmitted light effects can result if the opacity of the data carrier is suitable, because the screens supplement each other on the front and back of the data carrier, for example, or yield mixed colors in the case of a suitable overlap of the printed screens.

We claim:

1. A data carrier with an optically variable structure verifying the authenticity of the data carrier and having a first embossed structure which is combined with a first coating contrasting with the surface of the data carrier in such a way that at least partial areas of the coating are visible upon perpendicular viewing but concealed upon oblique viewing from a predetermined viewing direction so that a tilting effect occurs upon alternate perpendicular and oblique viewing, wherein the optically variable structure is divided into at least two areas, and wherein the first coating and the first embossed structure are disposed in a first one of said at least two areas, and a second embossed structure different from the first embossed structure and combined with a second coating different from the first coating and contrasting with the surface of the data carrier in such a way that at least partial areas of the second coating are visible upon perpendicular viewing but concealed upon oblique viewing from a predetermined viewing direction so that a tilting effect occurs upon alternate perpendicular and oblique viewing is present in the second one of said at least two areas.

2. The data carrier of claim 1 wherein the first and second embossed structures are each periodic embossed screens with a predetermined embossed height pattern, predetermined embossed amplitude and orientation and having zeniths in an area of maximum embossed amplitudes and valleys in an area of minimum embossed amplitudes which are connected via flanks.

3. The data carrier of claim 2 wherein the orientation of the first and second embossed screens is different.

4. The data carrier of claim 3 wherein the first and second embossed screens extend at right angles to each other.

5. The data carrier of claim 3 wherein the first and second coatings are designed in the form of screen structures and wherein the screen structures are differently oriented.

6. The data carrier of claim 5 wherein the coatings are formed as line screens and wherein the lines are disposed in the zeniths of the embossed screens.

7. The data carrier of claim 5 wherein the coatings are formed as line screens and wherein the lines are disposed on the flanks of the embossed screens.

8. The data carrier of claim 1 wherein the embossed structure is selected from the group consisting of trapezoidal, sinusoidal, semicircular and triangular.

9. A data carrier with an optically variable structure verifying the authenticity of the data carrier and having a first embossed structure with a predetermined extending direction, wherein the embossed structure is combined with a coating contrasting with the surface of the data carrier in such a way that at least partial areas of the coating are visible upon perpendicular viewing but concealed upon oblique viewing from a predetermined viewing direction so that a tilting effect occurs upon alternate perpendicular and oblique viewing, wherein the optically variable structure contains visible information, wherein a second embossed structure whose extending direction extends at right angles to the extending direction of the first embossed structure is present in the area of the information, said coating extending over said second embossed structure.

10. The data carrier of claim 9 wherein the coating and the embossed structures are additionally overlaid or underlaid with a transparent, optically variable layer.

11. A data carrier with an optically variable structure verifying the authenticity of the data carrier and having an embossed structure with predetermined orientation, wherein the embossed structure is combined with a coating contrasting with the surface of the data carrier in such a way that at least partial areas of the coating are visible upon perpendicular viewing but concealed upon oblique viewing from a predetermined viewing direction so that a tilting effect occurs upon alternate perpendicular and oblique viewing, wherein the coating is a two-colored screen structure comprising screen elements of a first color and screen elements of a second color, and wherein the optically variable structure has at least one piece of information formed by uncolored interruptions in at least one of the colors of the screen structure.

12. The data carrier of claim 11 wherein the embossed structure is a periodic embossed screen, and wherein the screen elements of a color are disposed on flanks of like orientation of the embossed structure.

13. The data carrier of claim 12 wherein the screen structure consists of lines of a first color and lines of a second color which directly adjoin each other alternatingly.

14. The data carrier of claim 11 wherein the optically variable structure has two pieces of information each formed by interruptions in both colors of the screen structure.

15. The data carrier of claim 11 wherein the configuration of the embossed structure is selected from the group consisting of trapezoidal, sinusoidal, semicircular and triangular.

* * * * *